United States Patent [19]

Moon et al.

[11] 4,398,508

[45] Aug. 16, 1983

[54] ENGINE COOLING FAN CONSTRUCTION

[75] Inventors: Charles L. Moon; Joseph T. Cieszko, both of Richmond Heights, Ohio

[73] Assignee: Volvo White Truck Corporation, Greensboro, N.C.

[21] Appl. No.: 236,590

[22] Filed: Feb. 20, 1981

[51] Int. Cl.[3] ..... F01P 5/06

[52] U.S. Cl. ..... 123/41.49; 165/121; 415/174

[58] Field of Search ..... 123/41.11, 41.49, 41.58, 123/41.59, 41.65, 41.66, 41.12, 41.46, 41.56, 41.63; 415/144–146, 164, 165, 174, 215, 219 R; 165/121, 122, 135; 98/10, 14, 33 R, 39, 43 R, 94 R

[56] References Cited

U.S. PATENT DOCUMENTS

| | | | |
|---|---|---|---|
| 2,030,993 | 2/1936 | Langenkamp et al. | 98/94 R |
| 3,321,931 | 5/1967 | Lehmkuhl | 62/281 |
| 3,680,977 | 8/1972 | Rabouyt et al. | 415/172 |
| 3,701,536 | 10/1972 | Matthews et al. | 415/174 X |
| 3,794,001 | 2/1974 | Birch et al. | 123/41.49 X |
| 3,799,128 | 3/1974 | Small | 123/41.49 |
| 3,947,148 | 3/1976 | Holt | 415/174 X |
| 4,022,481 | 5/1977 | Long et al. | 415/174 X |
| 4,329,946 | 5/1982 | Longhouse | 123/41.49 |

FOREIGN PATENT DOCUMENTS

| | | | |
|---|---|---|---|
| 2330859 | 7/1977 | France | 123/41.11 |

*Primary Examiner*—William A. Cuchlinski, Jr.
*Attorney, Agent, or Firm*—Watts, Hoffmann, Fisher & Heinke Co.

[57] ABSTRACT

A resiliently flexible seal for use in substantially reducing recirculation of air from a fan discharge side to a fan suction side through a clearance between cooperating fan and shroud members of a fan assembly. The resiliently flexible seal is disposed in the clearance and maintains virtually continuous sealing contact with both the fan and the shroud members.

16 Claims, 3 Drawing Figures

ENGINE COOLING FAN CONSTRUCTION

BACKGROUND OF THE INVENTION

1. Field of Invention

This invention relates generally to internal combustion engine cooling systems and more particularly to liquid cooled automotive vehicle engines which employ liquid to air heat exchangers, referred to as "radiators", and associated fans for forcing a flow of cooling air into heat exchange relationship with the radiators.

The efficiency of a fan is dependent in part upon the quantity of air which moves past the blade tips from the discharge side to the suction side of the fan. This air movement, which is referred to as "recirculation" can be reduced significantly, but not eliminated entirely, if the fan blade is surrounded by a shroud. The quantity of recirculated air in a shrouded fan is dependent in part upon the radial clearance between the shroud and the fan blade tip portions. When the clearance is reduced the fan efficiency tends to be increased.

Automotive vehicles employing liquid cooled engines are frequently provided with shrouded fans for forcing flows of cooling air across the coolant system radiators. In farm tractors or highway trucks the fan and surrounding shroud are frequently separately mounted. For example, in many such vehicles the fan is carried by the engine while the shroud is attached to the radiator. When such a vehicle is operated over rough terrain or rough roadways, the fan and shroud can experience relatively significant motion relative to each other, necessitating provision of a substantial clearance between the fan blade tips and the shroud to prevent the fan blades from striking the shroud at the extremes of the relative motion.

2. Prior Art

A number of devices have been proposed to reduce the clearance between fan blades and a surrounding shroud while still allowing for motion of the fan radially and axially relative to the shroud without substantial risk of resultant collision damage. These devices have either limited the relative radial and axial motion between the fans and the shrouds or provided clearances radially outwardly from the blades which has resulted in less than optimum fan efficiency due to air recirculation through the clearance.

One proposed solution provided a flexible sealing assembly received by a recess in the fan shroud, and a seal engaging assembly attached to the fan blades and riding, as if in a track, in the recess. This approach enabled only relatively limited radial and axial relative motion between the fan and shroud.

In another proposed solution an inflatable tube was mounted in the clearance between the fan blade tips and shroud. The tube was inflated to reduce clearance between the blade tips and the shroud when the fan was required to direct a maximized flow of cooling air across the radiator, and was deflated when the engine cooling system load was small and did not require a high degree of fan efficiency. When relative motion occurred between the fan and the shroud, collisions between the fan blades and the inflatable tube were frequent and precipitated early tube failures.

In still another proposal a resilient membrane, slotted for increased resiliency, was attached circumferentially about the shroud in the plane of the fan and was spaced radially from the fan blades. When large amounts of air were rammed through the fan by virtue of vehicle forward motion, the resiliently flexible membrane was deflected away from the fan blades by the ram air flow. This proposal tended to reduce the possibility of fan blade-shroud collisions at high vehicle speeds but was not as effective at low vehicle speeds.

Another proposal involved attaching an abradable foam strip about the inner shroud surface occupying most of the clearance between the shroud and fan. The fan abraded the foam strip during periods of relative motion between the fan and the shroud until a sufficiently large clearances was formed between the fan blades and the shroud. This abrasion process resulted in a clearance between the fan blades and the foam strip and as a result achieved only a partial reduction in recirculation of air around the fan.

SUMMARY OF THE INVENTION

The present invention provides a new and improved fan assembly wherein a resiliently flexible seal maintains virtually continuous sealing contact between a fan and a surrounding shroud member despite relative nonrotational motion between the fan and shroud, to substantially reduce recirculation of air from the discharge side of the fan to its suction side and thereby increase the fan efficiency.

In a preferred embodiment of the invention a rotatable fan member is surrounded by a shroud member spaced radially outwardly from the fan member so that a clearance is defined between the members. A flexible seal is disposed in the clearance. The seal is fixed to one of the members and maintains substantially continuous contact with the other member.

In a preferred embodiment the flexible seal is attached to the shroud member and maintains substantially continuous contact with the fan member during fan rotation. Where a large clearance would otherwise be necessary to accommodate significant motion between the fan and shroud member axes, the seal is capable of undergoing and recovering from considerable shape deformation when contacted by a blade tip, while still retaining sealing contact.

The preferred seal includes a plurality of resiliently flexible bristles. These bristles are oriented at a generally uniform angle to the fan axis and are arranged in a relatively dense brush-like array about the fan so that they form an effective barrier against air flow through the clearance. The bristles, individually, are somewhat longer than the magnitude of the clearance so that continuous seal contact is maintained between the fan and shroud members not withstanding relative motion between them.

Typically the fan is comprised of a plurality of relatively rigid fan blades carried by a rotatable hub with no interconnecting support structure between them. The seal maintains virtually continuous contact with the fan blade tips with passage of a blade tip through the seal bristles displacing the bristles momentarily from an at rest position. After passage of a blade tip the bristles rebound to their rest positions for making sealing contact with the next succeeding blade tip.

Fan assemblies embodying the invention are particularly useful in automotive vehicles employing a liquid cooled engine. In such a vehicle, the radiator carrying the shroud member is supported by the vehicle independently from the engine. The engine supports and drives the fan member. The flexible seal is anchored to an inner periphery of the shroud member in the general rotational plane of the fan and the flexible bristles maintain virtually continuous contact with the radial extremities of the fan member throughout any non-rotational relative motion between the fan member and shroud member.

The seal greatly reduces recirculation of air from the discharge to the suction side of the fan, thus improving the fan efficiency. This has the effect of reducing the power required to drive the fan for producing a given air flow requirement.

As a result of the improved efficiency, these fans may be smaller than prior art fans, or may be operated at lower rotational velocities in satisfying a given air flow requirement. Since fan noise is partly a function of blade tip tangential velocity, fans constructed according to the invention can operate more quietly in satisfying a given air flow requirement than equivalent prior art fans.

Other features and advantages of the invention will become more apparent from the following detailed description when considered in connection with the accompanying drawings.

PREFERRED EMBODIMENT OF THE INVENTION

Figure 1:
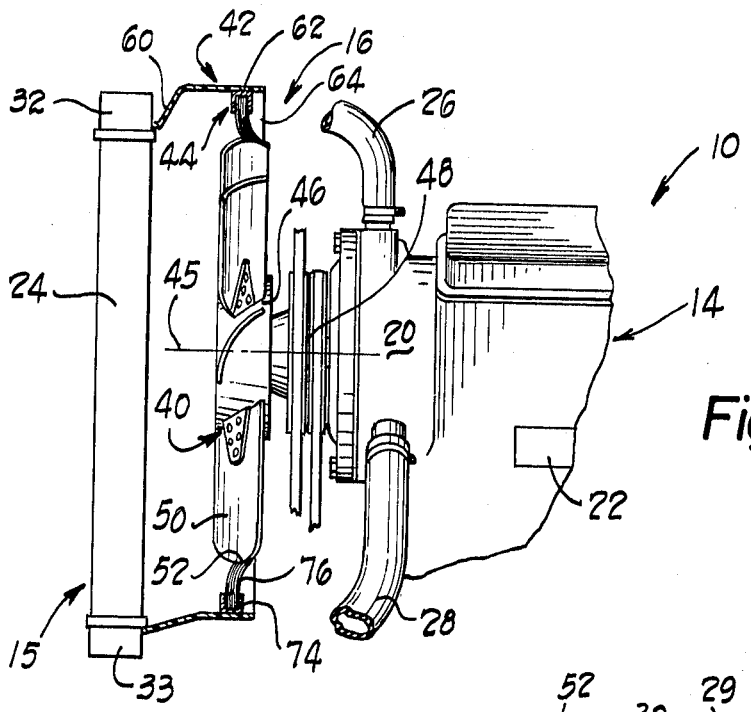
FIG. 1 is a fragmentary elevational view of part of a vehicle embodying the present invention.
Figure 2:
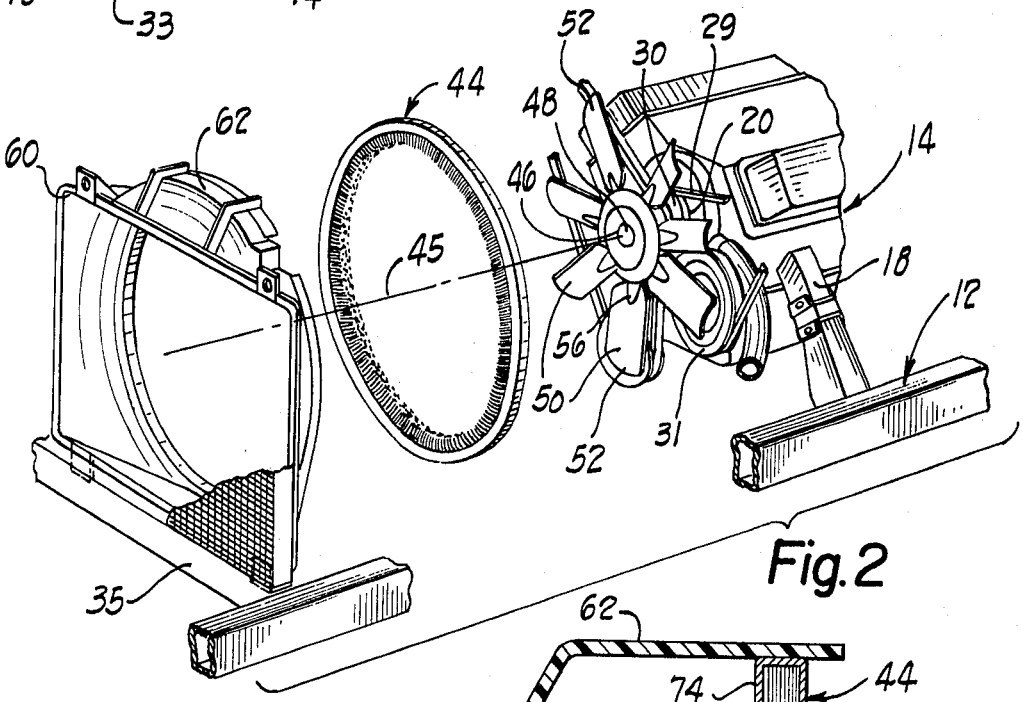
FIG. 2 is an exploded perspective view of part of the vehicle of FIG. 1; and, FIG. 3 is a fragmentary view of a portion of FIG. 1 shown on an enlarged scale.

Referring to the drawings, a portion of an automotive vehicle 10 is shown in FIGS. 1 and 2. The vehicle 10 includes a chassis 12 (FIG. 2) and an engine 14 resiliently supported by the chassis. An engine cooling system 15 is associated with the engine 14 and functions to cool the engine in cooperation with a fan assembly 16 embodying the invention.

The engine 14 is a liquid cooled internal combustion engine of any suitable or conventional type. Engine mounts 18 resiliently support the engine 14 on the chassis 12 to absorb shocks and vibration associated with operation of the engine and to cushion the engine from shocks which would otherwise be applied to it as a result of operating the vehicle over rough terrain or rough roadways. Consequently the engine and chassis move relative to each other during operation of the vehicle 10.

The engine cooling system 15 relies upon circulation of cooling liquid to transfer heat from the engine and includes an engine driven coolant circulating pump 20, coolant passages 22 in the engine block through which the coolant flows to acquire heat from the engine and a radiator 24 receiving coolant discharged by the pump through a hose 26. Atmospheric air passing across the radiator transfers heat from the coolant flowing through the radiator. Coolant which has passed through the radiator is directed to the passages 22 via a hose 28. The pump 20, as illustrated, is a conventional rotary pump having its impeller driven from the engine by a belt 29 reaved around pulleys 30, 31.

The radiator can be of any conventional construction and is illustrated as having top and bottom coolant tanks 32, 33 with coolant tubes (not shown) extending between the tanks. Heat dissipating fins are attached to and extend between the tubes horizontally across the radiator. The radiator 24 is supported on the chassis 12 and in the illustrated vehicle the radiator is connected to a cross member 35 of the chassis.

The fan assembly 16 moves air through the radiator to provide for a heat exchange with the coolant. The assembly 16 includes a fan member 40, a shroud member 42, and a seal 44. The fan member 40 is rotatable about an axis 45 and is supported within the shroud member 42 adjacent the radiator 24. The seal 44 coacts with the fan and shroud members to increase the fan assembly efficiency.

The fan member 40 is comprised of a hub 46 and a plurality of fan blades 50 each terminating in a tip portion 52. The hub 46 is rotatable about the axis 45 and connected to a driving shaft 48. In the illustrated embodiment the shaft 48 drives both the fan member 40 and the pump 20.

The fan blades 50 project radially from the hub 46 and are attached to the hub 46 in any suitable or conventional manner such as by spot welding each blade to a corresponding tongue 56 projecting from the hub. Each fan blade 50 is pitched and contoured to enhance its air moving capability. The blade tip portions 52 are spaced circumferentially apart and the blades are sufficiently stiff that the blades need not be interconnected by any supporting elements.

The shroud member 42 surrounds the fan member 40 and channels air flow through the radiator to the fan member. The shroud member includes a mounting portion 60 attached to the radiator and a tubular portion 62 extending about the fan member and supported by the mounting portion. The mounting portion 60 has a generally skirt-like configuration having a rectangular base connected about the periphery of the radiator remote from the tubular portion 62. Although the shroud member 42 is illustrated as a unitary structure formed of reinforced plastics or equivalent material, the mounting and tubular portion can be formed separately and assembled together.

The tubular shroud portion 62 is generally annular and spaced radially outwardly from the fan member to define a space or clearance 64 between the fan and shroud members. When the vehicle 10 is operated over rough terrain, or when the engine operates roughly, the engine 14 tends to move relative to the chassis on the resilient mounts 18. Since the fan member 40 is attached to the engine 14, and the shroud member 42 is attached to the chassis via the radiator 24, movement of the engine relative to the chassis results in relative motion between the fan member and the shroud member 42.

The seal 44 extends across the clearance 64 to minimize the recirculation of air from the fan member discharge side 68 to its intake side 70 while enabling radial and axial relative movement between the fan and shroud members. The seal 44 includes a mounting element 74 and a sealing element 76 carried by the mounting element and extending between the fan and shroud members through the clearance 64. In the preferred embodiment the mounting element 74 is attached to the shroud portion 62 and extends circumferentially completely about the fan member. The mounting element is bonded or otherwise securely attached to the inner periphery of the tubular shroud portion and anchors the resiliently flexible sealing element 76 in place between the shroud portion 62 and the fan blade tip portions 52. The sealing element 76 maintains virtually continuous contact with fan blade tip portions 52 during fan member rotation as well as during relative movement between the shroud member and the fan member radially and axially. This continuously sealing contact effectively prevents recirculation of air from the fan discharge side 68 to the fan suction side 70.

The resiliently flexible element of 76 of the seal 44 is comprised of a plurality of flexible bristles 80. In the preferred embodiment these bristles 80 are formed from a resinous material such as polypropylene or the like. Large numbers of the bristles are retained in the mounting element and comprise a closely packed, dense, relatively uniform bristle barrier throughout the circumference of the seal. The dense nature of the bristle arrangement provides an effective barrier to recirculation of air from the fan discharge side 68 to the suction side 70. The bristles are placed in the mounting element 74 so that they are all oriented at a generally uniform angle to the fan axis 54 when the mounting element is installed in the shroud.

Figure 3:
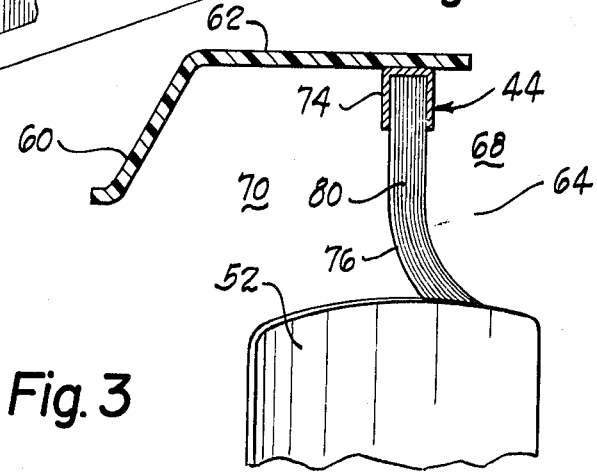

As illustrated by FIG. 3, in rotation, the blade tip portions 52 resiliently deflect the bristles 80 while moving along the seal 44. Because of their resilient nature, the bristles 80 spring back to their undeflected form disengagement with each fan blade. The bristles thus minimize the clearance between the fan and shroud by maintaining virtually continuous contact between the blade tips and the shroud. The resilient nature of the bristles enables deformation to a greater than usual extent without damage, when, for example, a fan blade 50 intrudes deeper into the seal structure in response to some large relative motion between the fan and the shroud. By the same token when the blade tips move relatively away from the bristles the bristles flex toward their undeflected positions without loosing contact with the blade tips.

The propylene resin from which the bristles 80 are formed, provides a bristle which, while resilient, is also abrasion resistant. These bristles are also substantially resistant to the deleterious effects of temperature variation extremes such as might be encountered when utilizing the seal 44 on an automotive vehicle operated in environments ranging from tropical heat to artic cold.

Fans constructed according to the invention operate efficiently by virtue of reduced air recirculation resulting from use of the seal. Such a fan can satisfy a given air flow requirement at a lower operational rotational speed than a fan which does not employ the seal 44. Alternatively, a fan equipped with the seal 44 can have a smaller diameter than an equivalent prior art fan operated at the same speed and provide the same air flow. Fan noise is significantly dependent upon the tangential velocity of the blade tips, and since this tangential velocity in turn depends both upon fan rotational speed and the fan diameter, utilizing the seal 44 fans, provides for effective engine cooling air flows at reduced noise levels compared to prior art forms. The driving horsepower requirement for such fans is also lower.

Although a single embodiment of a preferred form of the invention has been illustrated and described in detail, the present invention is not to be considered limited to the precise construction disclosed. Various adaptations, modifications and uses of the invention may occur to those skilled in the art to which the invention relates and it is intended to cover all such adaptations, modifications, and uses which come within the spirit or scope of the appended claims.

What is claimed is:

1. A fan assembly including:

a fan member supported for rotation about an axis;

a tubular shroud member surrounding and spaced radially outwardly from the fan member, the members defining a clearance therebetween;

a flexible seal disposed in the clearance and fixed to one of the members, the other member when in use being in continuous contact with the seal.

2. The fan assembly of claim 1, the seal including a plurality of resiliantly flexible bristles disposed in the clearance and attached to said one of the members.

3. The fan of claim 2, wherein the bristles generally project at a uniform angle to the fan axis.

4. A fan assembly comprising:

(a) a rotatable fan member including radially extending blades terminating in tip portions;

(b) a tubular shroud member extending circumferentially about the fan and spaced radially outwardly from the tip portions, the members defining a clearance therebetween; and (c) a seal disposed in the clearance, the seal being fixed to one of the members, the other member when in use being in continuous contact with the seal.

5. A fan assembly comprising:

(a) a rotatable fan member supported for rotation about an axis including radially extending blades terminating in tip portions;

(b) a tubular shroud member extending circumferentially about the fan and spaced radially outwardly from the tip portions, the members defining a clearance therebetween; and, (c) a seal disposed in the clearance, the seal being formed by flexible bristles attached to one of the members, the other member when in use being in continuous contact with the seal.

6. The assembly of claim 5 wherein the seal is anchored to the shroud member with the bristles disposed in a substantially continuous strip about an inner circumference of the shroud member and projecting generally inwardly from the shroud member to the fan member.

7. The fan assembly of claim 5 wherein all bristles project at a substantially uniform angle to the axis of rotation of the fan.

8. The fan assembly of either of claims 2, or 5 wherein the flexible bristles include polypropylene resin.

9. In an automotive engine, a cooling system including a radiator, the improvement comprising:

a fan member including a plurality of blades each terminating in a tip portion;

the fan member being rotatably mounted intermediate a portion of the engine and the radiator;

a shroud assembly comprising:

(i) a shroud member connected to the radiator and extending axially adjacent to and outwardly from the blade tip portions, thereby defining a clearance between fan and shroud members;

(ii) a resiliently flexible fan seal disposed in the clearance and connected to the shroud member, the blade tip portions being in continuous contact with the seal during fan rotation.

10. The system of claim 9 wherein the flexible seal includes a plurality of flexible bristles projecting at a generally uniform angle to an axis of rotation of the fan.

11. The system of claim 9 wherein the flexible seal is comprised of polypropylene resin.

12. In a vehicle such as a highway truck or a tractor having a frame, and comprising:

(a) an engine supported by the vehicle frame;

(b) a radiator supported by the vehicle frame independently from the engine;

(c) conduits connecting the engine and radiator for communication of liquid coolant therebetween;

(d) a pump in driven relationship with the engine for pumping liquid coolant from the engine through the radiator back to the engine;

(e) a fan member mounted in spaced relationship to the engine and radiator including:

(i) a rotatable shaft defining a fan axis;

(ii) the shaft being in driven relationship with the engine whereby the shaft is caused to turn;

(iii) a hub supported by the shaft for rotation therewith;

(iv) a plurality of blades connected to the hub and radiating generally uniformly around the hub circumference, each blade terminating in a tip portion remote from the fan axis;

(f) a shroud assembly comprising:

(i) a tubular shroud member attached to the radiator and having an inner periphery, the blades and hub of the fan assembly being disposed within and surrounded by the shroud thereby defining a clearance between the shroud and fan members;

(ii) a resiliently flexible fan seal disposed in the clearance and circumferentially connected to the shroud periphery;

(iii) the fan blade tip portions when in use being in continuous contact with the seal when the fan is rotating, the seal including a plurality of individual resiliently flexible bristles.

13. In a fan assembly, a method for inhibiting recirculation of air through a clearance between tip portions of a fan member rotatably disposed within a shroud member and the shroud member, wherein a flexible seal is disposed in the clearance and connected to one of the members comprising the step of:

operating the fan with the other member in virtually continuous contact with the flexible seal.

14. A fan assembly comprising:

(a) a rotatably driven fan member having blades terminating in tip portions;

(b) a tubular shroud member surrounding the fan and defining a clearance between the fan and shroud members;

(c) the blade tip portions in rotation describing a circle, the circle and the shroud member being generally coaxial;

(d) the shroud including a flexible seal disposed in the clearance and connected to the shroud member; and (e) the blade tip portions being in continuous contact with the seal when the fan is rotated.

15. The fan assembly of any of claims 1, 4, 12, 13, or 14, wherein the resiliently flexible seal including polypropylene resin.

16. An internal combustion engine cooling system comprising:

a radiator mounted in spaced relationship with the engine and connected to the engine in coolant circulation relationship;

a rotatable fan member having blades terminating in tip portions and mounted in spaced relationship with the radiator;

a tubular shroud member connected to the radiator and surrounding the fan in air conducting relationship defining a clearance between fan and shroud members; and, the shroud including a resiliently flexible seal disposed in the clearance, the fan blade tip portions in continuous sealing contact with the seal when the fan is rotating.

* * * * *